US012708857B2

(12) United States Patent
DiDomenico et al.

(10) Patent No.: US 12,708,857 B2
(45) Date of Patent: Aug. 18, 2026

(54) PROP FOR AN ATTRACTION SYSTEM

(71) Applicant: Universal City Studios LLC, Universal City, CA (US)

(72) Inventors: Matthew DiDomenico, Orlando, FL (US); Aaron Chandler Jeromin, Winter Garden, FL (US)

(73) Assignee: Universal City Studios LLC, Universal City, CA (US)

( * ) Notice: Subject to any disclaimer, the term of this patent is extended or adjusted under 35 U.S.C. 154(b) by 410 days.

(21) Appl. No.: 18/455,116

(22) Filed: Aug. 24, 2023

(65) Prior Publication Data

US 2024/0066416 A1 Feb. 29, 2024

Related U.S. Application Data

(60) Provisional application No. 63/400,929, filed on Aug. 25, 2022.

(51) Int. Cl.
*A63G 31/02* (2006.01)

(52) U.S. Cl.
CPC ..... *A63G 31/02* (2013.01)

(58) Field of Classification Search
None
See application file for complete search history.

(56) References Cited

U.S. PATENT DOCUMENTS 5,198,893 A * 3/1993 Lang ..... B25J 9/0003 348/844
5,685,778 A 11/1997 Sheldon et al.
11,051,892 B2 7/2021 Hata et al.
2020/0215443 A1 7/2020 Brister et al.
2021/0268394 A1* 9/2021 Blum ..... A63J 25/00
2022/0143518 A1 5/2022 Chatrath et al.

FOREIGN PATENT DOCUMENTS

CN 107813305 B 3/2018

OTHER PUBLICATIONS

Dong, Xin et al.; "A Novel Continuum Robot Using Twin-Pivot Compliant Joints: Design, Modeling, and Validation," Journal of Mechanisms and Robotics, vol. 8, May 2016, 15 pgs.
Mishra, Anand Kumar et al.; "Modular Continuum Manipulator: Analysis and Characterization of Its Basic Module," Biomimetics, Feb. 14, 2018, 16 pgs.
Yeshmukhametov, Azamat et al.; "A Wire-Driven Discrete Continuum Robot Sliding and Non-sliding Backbone Design Analysis and Validation of Kinematics/Kinetics," Preprints, Dec. 3, 2020, 21 pgs.
Yigit, Cihat Bora et al.; "Design and Modelling of a Cable-Driven Parallel-Series Hybrid Variable Stiffness Joint Mechanism for Robotics," Mechanical Sciences, vol. 8, Mar. 22, 2017, pp. 65-77.
PCT/US2023/031080 International Search Report and Written Opinion mailed Jan. 2, 2024.

* cited by examiner

*Primary Examiner* — Omar S Parra
(74) *Attorney, Agent, or Firm* — Fletcher Yoder P.C.

(57) ABSTRACT

An prop of an attraction system includes a first plate, a second plate coupled to the first plate and configured to move relative to the first plate, and a biasing support coupled to and extending between the first plate and to the second plate. The biasing support includes a mesh structure and is configured to deform during relative movement between the first plate and the second plate, and the biasing support is configured to apply a force onto the first plate, the second plate, or both upon deformation.

19 Claims, 7 Drawing Sheets

PROP FOR AN ATTRACTION SYSTEM

CROSS REFERENCE TO RELATED APPLICATION

This application claims priority to and the benefit of U.S. Provisional Application No. 63/400,929, entitled "ANIMATED PROP FOR AMUSEMENT PARK SYSTEM," filed Aug. 25, 2022, the entire contents of which is hereby incorporated by reference in its entirety for all purposes.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Throughout amusement parks and other entertainment venues, special effects can be used to help immerse guests in the experience of a ride or attraction. Immersive environments may include three-dimensional (3D) props and set pieces, robotic or mechanical elements, and/or display surfaces that present media. In addition, the immersive environment may include audio effects, smoke effects, and/or motion effects. Thus, immersive environments may include a combination of dynamic and static elements. However, implementation and operation of special effects may be complex. For example, it may be difficult to operate certain elements of the special effects in a desirable manner to create the immersive environment, such as to actuate a prop to provide a desirable movement. With the increasing sophistication and complexity of modem ride attractions, and the corresponding increase in expectations among guests, improved and more creative attractions are desirable, including ride attractions having special effects to provide the immersive environment.

BRIEF DESCRIPTION

In an embodiment, a prop of an amusement system includes a first plate, a second plate coupled to the first plate and configured to move relative to the first plate, and a biasing support having a mesh structure coupled to and extending between the first plate and to the second plate. The biasing support is configured to deform during relative movement between the first plate and the second plate, and the biasing support is configured to apply a force onto the first plate, the second plate, or both upon deformation.

In an embodiment, a joint system includes a first plate, a second plate coupled to the first plate, a first extension coupled to the first plate at a first mounting point, a second extension coupled to the first plate at a second mounting point, and a biasing support coupled to the first plate and to the second plate. The biasing support is coupled to the first plate and to the second plate, wherein the biasing support has a first region in engagement with the first mounting point and a second region in engagement with the second mounting point, the first region of the biasing support has a first stiffness, the second region of the biasing support has a second stiffness, and the first stiffness and the second stiffness are different from one another.

In an embodiment, a method of actuating a prop includes moving, via an actuator of the prop, a first plate of the prop relative to a second plate of the prop, wherein the prop comprises a biasing support coupled to and extending between the first plate and the second plate, and the biasing support is configured to deform during movement between the first plate and the second plate.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
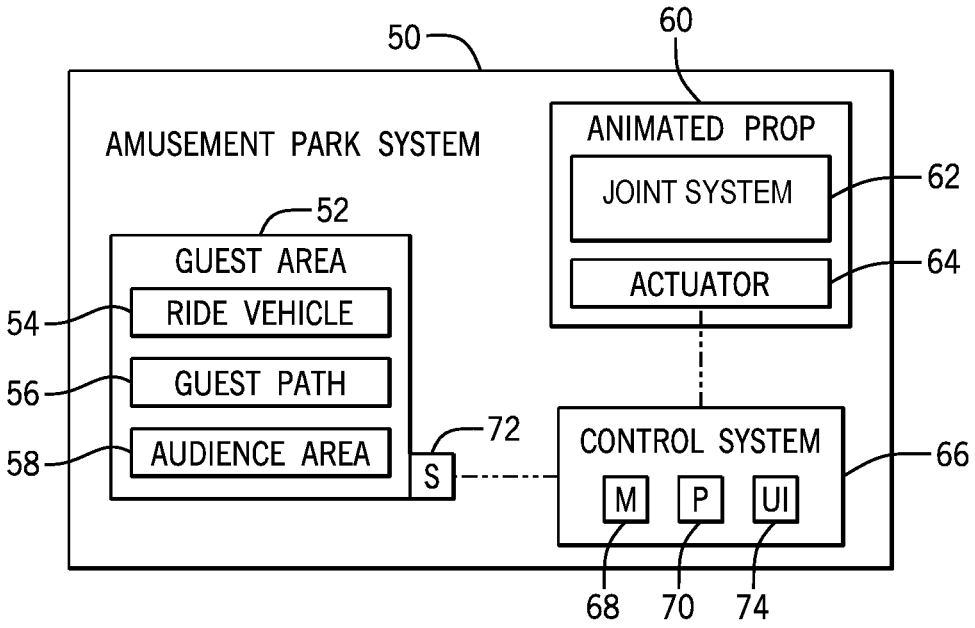
FIG. 1 is a block diagram of an embodiment of an attraction system having an prop with a joint system, in accordance with an aspect of the present disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present disclosure are directed to an attraction system. The attraction system may be an attraction system of an amusement park. Additionally or alternatively the system could be used outside of the entertainment industry and could include or be applied to, for example manufacturing, research, medical devices, generally the field of robotics, etc. The amusement park may include various attraction systems. An attraction system may include a ride (e.g., a roller coaster, a water ride, a drop tower), a performance show, a walkway (e.g., the walkway may include a static path and/or a moving walkway), and so forth, with features that may entertain guests (e.g., guests at an amusement park). The attraction system may also include a prop that may be activated to provide a desirable effect. For example, the prop may include actuatable portions, and the prop may be controlled to drive motion of and/or in such portions. Motion of and/or within such portions of the prop may provide a realistic appearance of the prop and/or enhance effects of an attraction and/or attraction system. As such, the prop may be controlled to provide a realistic, immersive environment to entertain the guests.

Unfortunately, it may be difficult to control desirable movement of props using conventional approaches. For example, it may be difficult to move parts of a prop to a desirable or target position with respect to one another in order to provide a desirable appearance of the prop. Additionally, or alternatively, a certain positioning of the prop that places various portions of the prop in relative orientations with respect to one another may impart an undesirable amount of stress on certain parts of the prop. Thus, movement of the prop, and corresponding effects provided to guests, may be undesirable.

Accordingly, it is presently recognized that improvements to control movement of a prop are desirable. Thus, embodiments of the present disclosure are directed to a prop with a joint system that facilitates movement and/or stability of the prop. The prop may include an animated prop, actuatable scenery, and/or an animated figure. An animated prop may include actuatable scenery and/or an animated figure. The joint system may include a joint assembly. The joint system may include multiple plates that are coupled to one another and configured to move relative to one another via intervening joints. Moving may include translating, rotating, orienting (e.g., changing orientation), and/or positioning (e.g., changing position). One or more extensions, such as cables, may be coupled to one or more of the plates. One or more respective actuators may adjust the extended length or lengths of the one or more extensions to apply a force that moves the plates relative to one another. Additionally, one or more biasing supports may be positioned between and coupled to adjacent plates. Each biasing support may apply a force to the plates to improve movement control of the plates. For example, the biasing supports may impart forces to dampen, limit, eliminate, and/or prevent unwanted movement (e.g., movement caused by forces that are not applied by the extensions) and/or unwanted forces (e.g., forces applied that are not applied by the extensions) between the plates to maintain desirable positioning between the plates. Additionally, the biasing supports may reduce stress imparted onto the extensions during movement (e.g., including unwanted movement) and/or actuation of the prop. For instance, during operation of one of the actuators to reduce the extended length of a first extension, the plates may move relative to one another (e.g., ends of the plates may move away from one another) and apply tensile forces to a second extension. However, a biasing support coupled to the second extension may absorb some of the tensile force, thereby reducing the tensile force applied to the second extension. As a result, the structural integrity of the second extension may be maintained. Additionally and/or alternatively, the biasing supports may reduce stress imparted onto the extensions when forces (e.g., forces may include unwanted forces) are applied to the prop. Unwanted forces may include forces external to the prop that are applied to the prop. For example, these may include dropping forces, force applied by wind, collision forces, acceleration forces from transporting the prop and/or other external forces. Unwanted movement may include movement induced by unwanted forces.

In an embodiment, a biasing support may include a mesh structure (e.g., lattice structure, webbed network) having struts and/or support structure that interconnect to form spaces and define open-celled arrangements. The mesh structure may be manufactured to have a particular profile that applies amounts of forces onto the plates in order to facilitate desirable positioning between the plates. As an example, the mesh structure may have an greater density (e.g., a structural material to open space ratio may be increased) to apply relatively greater forces onto the plates in comparison to a mesh structure with a lesser density, thereby increasing movement resistance to dampen, limit, eliminate, and/or prevent relative movement between the plates. Additionally, or alternatively, the mesh structure may have a lesser density (e.g., a structural material to open space ratio may be decreased) to apply relatively less forces onto the plates in comparison to a mesh structure with a greater density, thereby reducing movement resistance to facilitate relative movement between the plates. Indeed, a mesh structure having desirable structural characteristics (e.g., density of material) may be more easily manufactured to enable desirable relative movement between the plates, and therefore actuation of the prop, to be achieved. In an embodiment, the mesh structure may have a generally uniform design, with generally constant cell sizes throughout the structure. In an embodiment, the mesh structure may be non-uniform and have different cell sizes represented within the structure. Mesh structure density variations may result from altering the structure configuration and/or the material of the struts and/or support structure of the mesh structure.

With the preceding in mind, FIG. 1 is a block diagram of an attraction system 50. As an example, the attraction system 50 may include a ride (e.g., a roller coaster, a dark ride), a performance show, and the like. The attraction system may be part of an amusement park system (e.g., amusement park). As another example, the attraction system 50 may include and/or be part of a dining venue, a waiting area, a walkway, a shopping venue (e.g., a gift shop), or any other suitable part of an amusement park. The attraction system 50 may include a guest area 52 where guests may be located. For instance, the guest area 52 may include a ride vehicle 54, which may move and/or change its position, location, and/or orientation within the attraction system 50. Additionally or alternatively, the ride vehicle may move and/or change its position, location, and/or orientation within an amusement park. The guest area 52 may additionally, or alternatively, include a guest path 56 used by the guests to navigate (e.g., walk) through the attraction system 50, such as outside of the ride vehicle 54. The guest area 52 may further include an audience area 58, which may include a general space, such as a seating area and/or a standing area, where guests may be positioned. Indeed, the guest area 52 may include any suitable feature to accommodate the guests within the attraction system 50.

The attraction system 50 may also include prop 60 configured to provide entertainment to the guests of the guest area 52. The prop 60 may include an animated prop. For example, the prop 60 may provide an immersive environment for the guests, such as to establish a themed setting corresponding to the guest area 52. The animated prop 60 may include a joint system 62 (e.g., a cable driven spinal assembly, a ligament style mechanism, a hyper-redundant manipulator, a continuum robot, a continuum manipulator, a soft robotics system, a soft robotic manipulator) configured to actuate. As an example, the joint system 62 may be operated to adjust the positioning of the animated prop 60 and provide a realistic appearance of the animated prop 60. For instance, operation of the joint system 62 may provide realistic motion and/or actuation of the animated prop 60 and/or components thereof, thereby facilitating establishment of a realistic environment for the guests.

In an embodiment, the prop 60 may include or be coupled to an actuator 64 configured to drive and/or actuate the joint system 62, thereby articulating, actuating, and/or animating the prop 60. By way of example, the actuator 64 may be communicatively coupled to a control system 66 (e.g., an automation controller, a programmable controller, an electronic controller, control circuitry) configured to operate the actuator 64. The control system 66 may include a memory 68 and processing circuitry 70. The memory 68 may include volatile memory, such as random access memory (RAM), and/or non-volatile memory, such as read-only memory (ROM), optical drives, hard disc drives, solid-state drives, or any other non-transitory computer-readable medium that includes instructions to operate the attraction system 50. The processing circuitry 70 may be configured to execute such instructions. For example, the processing circuitry 70 may include one or more application specific integrated circuits (ASICs), one or more field programmable gate arrays (FPGAs), one or more general purpose processors, or any combination thereof.

The control system 66 may be configured to control (e.g., instruct) the actuator 64 to control actuation of the joint system 62 and therefore of the prop 60. In one embodiment, the control system 66 may be communicatively coupled to a sensor 72 and may operate based on data received from the sensor 72. As an example, the sensor 72 may be configured to measure, detect, and/or determine an operating parameter of the guest area 52, such as a positioning of the guests (e.g., relative to the prop 60), a positioning of the ride vehicle 54 (e.g., relative to the prop 60), a quantity of guests, and the like. As another example, the sensor 72 may be configured to determine a different operating parameter, such as a time of day, a ride cycle, a user interaction with the prop 60, and so forth. The control system 66 may be configured to operate the actuator 64 automatically (e.g., without additional user input, such as from the guest, an operator, and/or a technician) based on the data received from the sensor 72. The control system 66 may operate the actuator by controlling (e.g., instructing) the actuator 64. The sensor 72 may include a control system or be communicatively coupled with a control system that does the above determining. Additionally or alternatively, the control system 66 may receive data measured and/or detected by the sensor 72 and determine the operating parameter of the guest area 52 and/or the different operating parameter. As another example, the control system 66 may be configured to operate the actuator 64 based on a user input. To this end, the control system 66 may include a user interface (UI) 74 with which a user may interact. The UI 74 may include, for instance, a touch screen, a switch, a button, a track pad, a gestural sensor, a dial, another suitable feature, or any combination thereof. Interaction between the user and the UI 74 may transmit the user input, and the control system 66 may actuate the actuator 64 based on the user input. As such, the control system 66 may cause actuation of the joint system 62 and therefore of the prop 60 in response to receipt of the user input. The prop 60, the joint system 62, guest area 52, the control system 66, the actuator 64, and/or the sensor 72 may all include and/or may be communicatively coupled with receivers, transmitters, and/or transceivers and may communicate between each other via the receivers, transmitters, and/or transceivers.

As further described herein, the joint system 62 of the prop 60 may include a variety of components that are movable and/or adjustable in position and/or orientation with respect to one another to allow actuation of the joint system 62. Actuation of the joint system may include moving and/or adjusting of a position and/or orientation of a component of the joint system relative to another component of the joint system. The joint system 62 may also include one or more supports that are coupled to the components. The one or more supports may facilitate actuation, stability, and/or positioning of the joint system 62 and/or one or more components thereof. In this manner, the joint system 62 may be better operated (e.g., via the actuator 64, via the control system 66) to provide a desirable appearance of the prop 60. For example, the structure of the joint system 62 may have a spring constant and may impart forces that reduce stress applied to certain components of the joint system 62 and/or that facilitate an amount of relative movement between certain components of the joint system 62. Thus, the joint system 62 may be more desirably operated.

Figure 2:
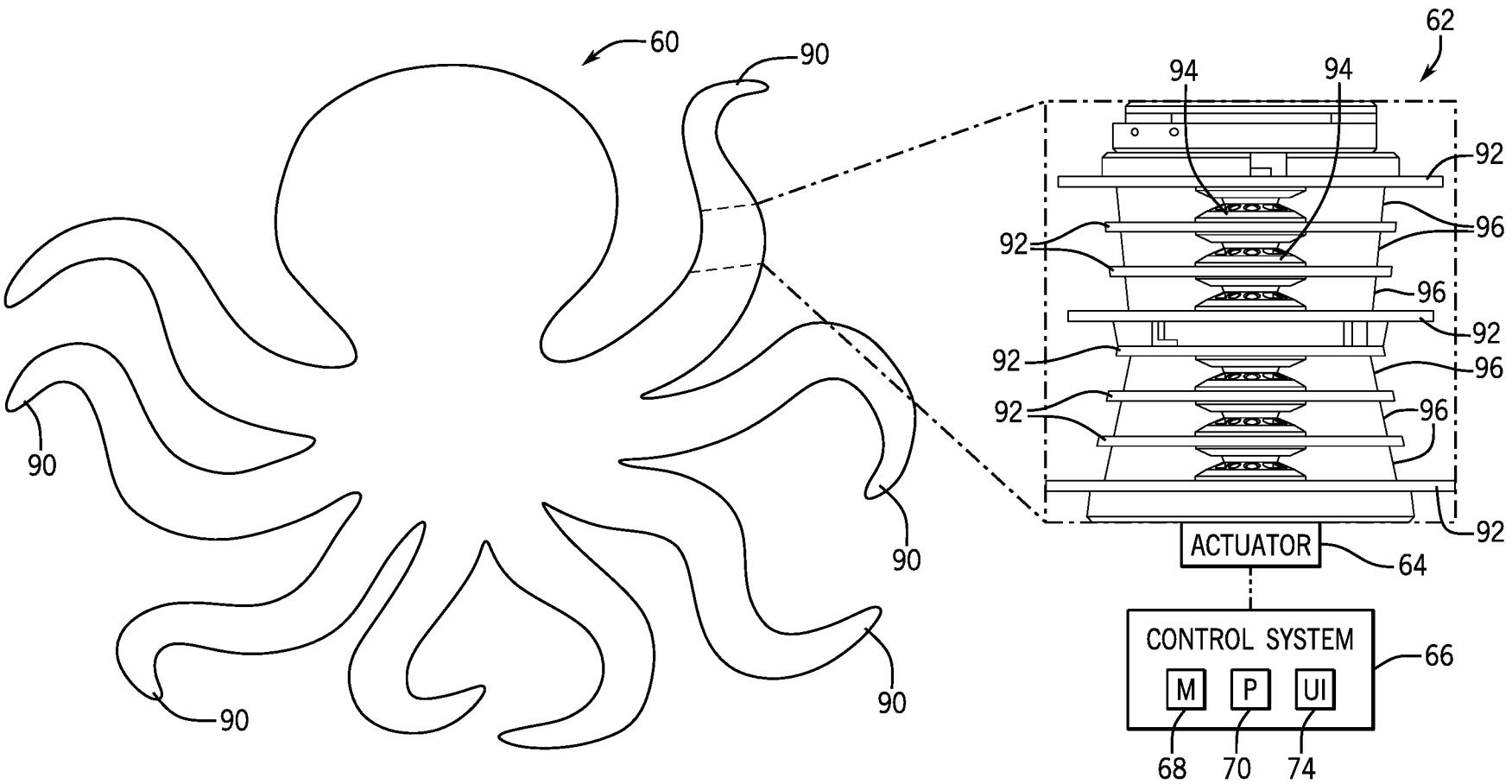
FIG. 2 is a schematic diagram of an embodiment of a prop having a joint system, in accordance with an aspect of the present disclosure.

FIG. 2 is a schematic diagram of an embodiment of the prop 60 that may utilize the joint system 62. In the illustrated embodiment, the prop 60 includes an octopus having multiple tentacles 90. However, other prop arrangements are also contemplated. One or more of the tentacles 90 may employ the joint system 62 to actuate, such as to bend, flex, curve, twist, and so forth, thereby providing appearance of realistic motion (e.g., of areal world octopus). For example, the joint system 62 may include a plurality of plates 92, and adjacent plates 92 may be coupled to one another at joints 94. The joints 94 may include a ball and socket joint, a universal joint, or another suitable joint that may couple, attach, and/or connect the plates 92 to one another. In such an embodiment, the plates 92 may be separate components coupled, attached, and/or connected to one another via the joints 94. Additionally, or alternatively, the plates 92 may be a part of a single integral material (e.g., a stiff flexible plastic) that may be deformable (e.g., elastically deformable). In either case, the plates 92 may move relative to one another via the joints 94, thereby causing actuation of the tentacle 90.

The joint system 62 may also include a biasing support 96 extending between adjacent plates 92. That is, the biasing support 96 may occupy at least a portion of the space or gap formed between the adjacent plates 92. For example, the biasing support 96 may be coupled to and/or secured to opposing surfaces of each of the adjacent plates 92. Thus, movement of the plates 92 relative to one another may cause corresponding adjustment, deformation, and/or distortion of the biasing support 96. As an example, movement of the plates 92 toward one another may compress a portion of the biasing support 96. As another example, movement of the plates 92 away from one another may stretch or expand a portion of the biasing support 96. For this reason, the biasing support 96 may be composed of a flexible material, such as a mesh structure, elastically deformable material, a foam, a spring, and so forth, to enable adjustment of a shape of the flexible material, thereby facilitating movement of the plates 92 relative to one another.

The biasing support 96 may also apply a force to the plates 92 to which the biasing support 96 is coupled, and the amount of force applied to the plates 92 may be based on a spring constant of the biasing support 96. As an example, in a default configuration (e.g., an inactive configuration, an unactuated configuration) of the joint system 62, such as a configuration in which adjacent plates 92 are oriented generally parallel to one another, the biasing support 96 may be pre-compressed and/or pre-tensioned to dampen, limit, eliminate, and/or prevent unwanted relative movement between the plates 92. Pre-compressing the biasing support 96 (e.g., the plates 92 compress the biasing support 96 in the default configuration) may cause the biasing support 96 to apply a corresponding force onto each of the plates 92 to dampen, limit, eliminate, and/or prevent movement (e.g., translation, rotation, and/or orientation) of the plates 92 toward one another. Pre-tensioning the biasing support 96 (e.g., the plates 92 apply tension to the biasing support 96 in the default configuration) may cause the biasing support 96 to apply a corresponding force onto each of the plates 92 to dampen, limit, eliminate, and/or prevent movement (e.g., translation, rotation, and/or orientation) of the plates 92 away from one another. In either case, the biasing support 96 may reduce unwanted movement between the plates 92 and increase stability of the default configuration, thereby maintaining desirable positioning of the plates 92 relative to one another. Further, the biasing support 96 may act to smooth actuation of individual plates 92, creating a more realistic motion profile.

As another example, in a motion configuration (e.g., an active configuration, an actuated configuration) of the joint system 62 in which the plates 92 are moved relative to one another, such as via the actuator 64, the biasing support 96 may apply a different amount of force and/or displacement to different parts of the plates 92. For instance, the biasing support 96 may provide a force on first parts (e.g., first edges, face, and/or surface) of the plates 92 to urge the first parts of the plates 92 away from one another, and the biasing support 96 may provide a force on second parts (e.g., second edges, face, and/or surface opposite the first edges, face, and/or surface) to urge the second parts of the plates 92 toward one another. Urging may include moving, translating, rotating, and/or orienting. As further described herein, such forces imparted by the biasing support 96 onto the plates 92 may reduce stress imparted onto other components of the joint system 62.

Actuation of the actuator 64 (e.g., extension and/or retraction and/or rotation of one or more components of the actuator) may cause relative movement of the plates 92 to adjust a shape of the joint system 62, thereby actuating the joint system 62. The biasing support 96 may facilitate such movement of the plates 92, thereby enabling desirable positioning, orientation and/or actuation of the joint system 62. For example, the biasing support 96 may reduce an amount of force and/or torque applied by the actuator 64 to move the plates 92. In an embodiment in which the control system 66 is communicatively coupled to the actuator 64, the biasing support 96 may facilitate operation of the control system 66 to operate the joint system 62 via the actuator 64. Thus, the biasing support 96 may facilitate operation of the prop 60 to provide a desirable effect via the joint system 62.

The biasing support 96 may include a gel, semisolid, and/or fluid (e.g., liquid, gas) and, where appropriate, a membrane to contain the gel, semisolid, and/or fluid. In embodiments, the biasing support 96 may contain areas of different geometric structure and/or material. This may allow for different distribution of forces throughout different areas of the biasing support 96. The biasing support 96 may include multiple sections containing different materials and/or geometric structures and these multiple sections could be stacked, side-by-side, nested, spaced apart. The biasing support geometry may include direction-biased geometry. This may include geometry that allows greater deformation in one direction under one magnitude of force, but less deformation in a different direction under the same magnitude of force.

Figure 3:
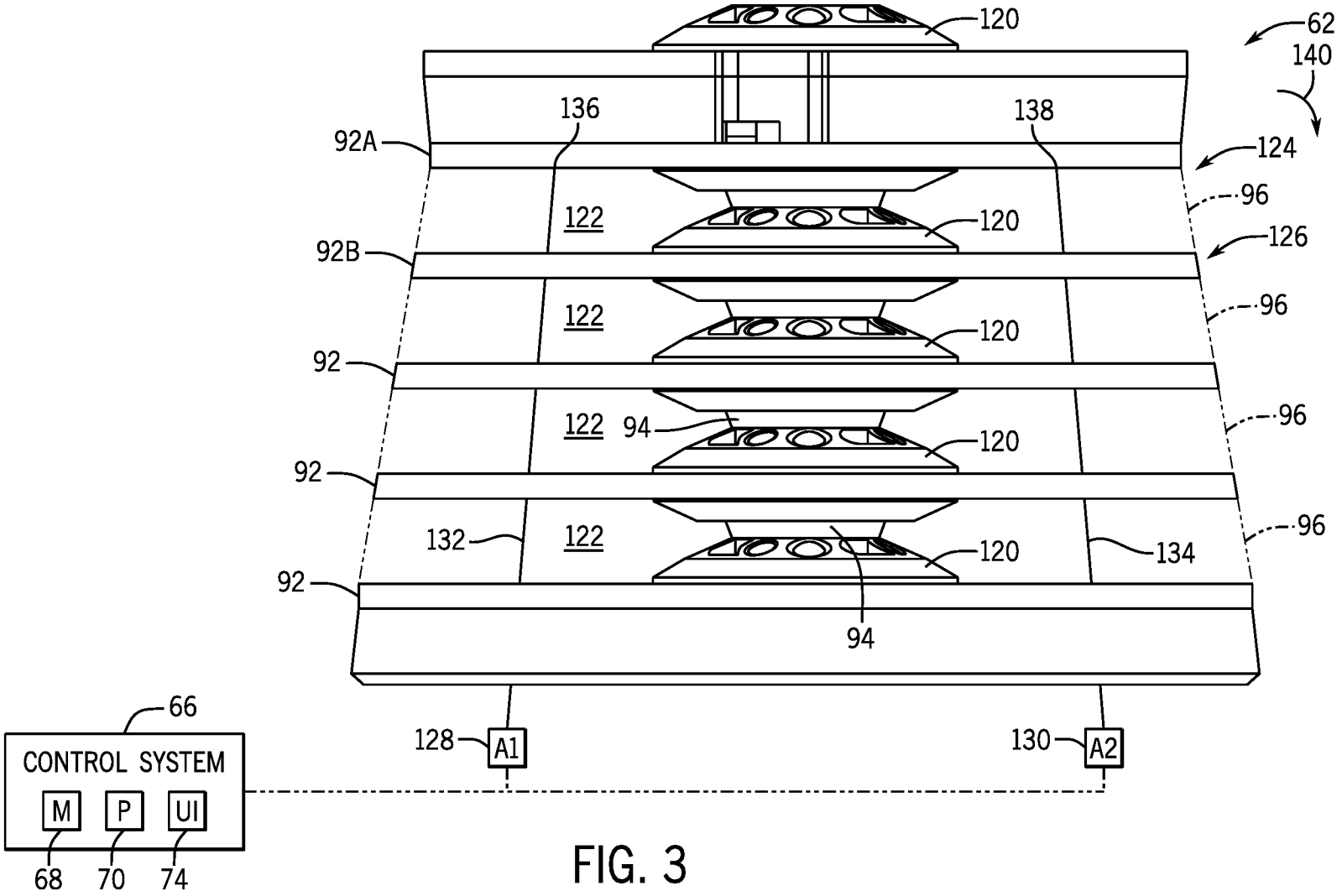
FIG. 3 is a side view of an embodiment of a joint system that may be employed in a prop, in accordance with an aspect of the present disclosure.

FIG. 3 is a side view of an embodiment of the joint system 62. For example, the illustrated embodiment may include a default configuration of the joint system 62. Each of the plates 92 may include a base 120, and the bases 120 of adjacent plates 92 may be coupled to one another at the respective joints 94. The joints 94 may allow and/or enable relative movement between the bases 120 to enable relative movement between the plates 92. Additionally, the bases 120 may offset adjacent plates 92 from one another to form a space 122 between the adjacent plates 92. A biasing support 96, shown in phantom lines, may be positioned between adjacent plates 92 and extend through the space 122 and, for example, may surround the joints 94 and/or the bases 120 within the spaces 122. In the illustrated example, the biasing support 96 are coupled to plate edges such that the biasing support 96 is generally positioned at or near a perimeter of one or more plates 92. The biasing support 96 may extend at least in part into the interior space 122 in some embodiments.

As discussed herein, the biasing support 96 may be secured to each of the adjacent plates 92. For instance, a first side 124 of one of the biasing supports 96 may be coupled and/or attached to a first plate 92A (e.g., an end plate), thereby dampening, limiting, eliminating, and/or preventing relative movement between the first side 124 of the biasing support 96 and the first plate 92A. A second side 126, opposite the first side 124, of the biasing support 96 may be coupled and/or attached to a second plate 92B (e.g., an intermediate plate adjacent to the end plate), thereby dampening, limiting, eliminating, and/or preventing relative movement between the second side 126 of the biasing support 96 and the second plate 92B. As such, relative movement between the first plate 92A and the second plate 92B may cause relative movement between the first side 124 and the second side 126 of the biasing support 96 to adjust a geometry of the biasing support 96 (e.g., to stretch the biasing support 96, to compress the biasing support 96). Adjustment of the geometry of the biasing support 96 (e.g., by applying a force, pressure, and/or displacement to the biasing support) may cause the biasing support 96 to impart a force onto the first plate 92A and/or the second plate 92B to facilitate adjusting the relative movement between the first plate 92A and/or the second plate 92B and/or maintaining positioning of the first plate 92A and/or of the second plate 92B. Modifying a default geometry (e.g., changing the design of the geometry, not the current amount of force on the biasing support 96) may alternatively change how the biasing support 96 and the rest of the system acts when a force is applied to the biasing support 96. The biasing support 96 may be a unitary structure that couples to each of the plates 92. In an embodiment, the biasing support 96 may be formed from separate substructures that individually couple to adjacent plates 92 to extend therebetween.

In the illustrated embodiment, a first actuator 128 (e.g., a first motor, a first winch) and a second actuator 130 (e.g., a second motor, a second winch) may operate to actuate the joint system 62. By way of example, the first actuator 128 may be include or be coupled to a first extension 132, such as a first cable, a first wire, a first rope, and the like. The second actuator 130 may include or be coupled to a second extension 134, such as a second cable, a second wire, a second rope, and the like. The first extension 132 may also be coupled to the first plate 92A, and an extended length of the first extension 132 may span from the first actuator 128 to the first plate 92A. The second extension 134 may be similarly coupled to the first plate 92A, and a length of the second extension 132 may span from the second actuator 130 to the first plate 92A. Each of the extensions 132, 134 may extend through the other plates 92 (e.g., the second plate 92B) to the first plate 92A. To this end, the other plates 92 may also include openings through which the extensions 132, 134 may extend. The extensions, e.g., extension 132, 134, may couple to plates other than the first plate 92A and different extensions may couple to different plates.

The openings of the other plates 92 may enable relative movement between the extensions 132, 134 and the other plates 92. For example, the extensions 132, 134 may be slidable through the openings of the other plates 92. However, the extensions 132, 134 may be fixedly coupled to the first plate 92A. For instance, the first extension 132 may be coupled to a first mounting point 136 of the first plate 92A, and the second extension 134 may be coupled to a second mounting point 138 of the first plate 92A. By way of example, the mounting points 136, 138 may be positioned at opposite ends of the first plate 92A. Relative movement between the extensions 132, 134 and the other plates 92 may drive relative movement between the mounting points 136, 138, respectively, and the other plates 92, thereby driving movement of the first plate 92A relative to the other plates 92 to actuate the joint system 62. By way of example, retracting (e.g., reducing the extended length of) the extensions 132, 134 spanning from the actuators 128, 130, respectively, to the first plate 92A (e.g., to the mountings points 136, 138) may drive movement of the first plate 92A toward the other plates 92 (e.g., toward the actuators 128, 130). Extending (e.g., increasing the extended length of) the extensions 132, 134 spanning from the actuators 128, 130 to the first plate 92A may drive movement of the first plate 92A away from the other plates 92 (e.g., away from the actuators 128, 130).

For instance, actuation of the second actuator 130 to retract the second extension 134 spanning from the second actuator 130 to the first plate 92A (e.g., by reeling or winding the second extension 134) may apply a force to the first plate 92A at the second mounting point 138 to drive the second mounting point 138 toward second plate 92B via the joint 94 coupling and/or connecting the first plate 92A to the second plate 92B. Such movement of the first plate 92A relative to the second plate 92B may further apply a force that drives similar movement of the second plate 92B toward an adjacent plate 92 via a corresponding joint 94, and similar forces may be applied to remaining plates 92 to drive relative movement between remaining plates 92. Additionally, movement of the second mounting point 138 toward the second plate 92B, as caused by retracting the second extension 134 spanning from the second actuator 130 to the first plate 92A, may cause the first mounting point 136 to move away from the second plate 92B, cause the second plate 92B to move away from an adjacent plate 92 in a similar manner, and so forth. As such, the extended length of the first extension 132 spanning from the first actuator 128 to the first plate 92A may be increased (e.g., the first actuator 128 may provide additional slack of the first extension 132). In this manner, retracting the second extension 134 spanning from the second actuator 130 to the second mounting point 138 and correspondingly increasing of the extended length of the first extension 132 spanning from the first actuator 128 to the first mounting point 136, as caused by actuation of the second actuator 130, may cooperatively cause relative rotation of the plates 92 in a rotational direction 140 with respect to one another. As such, operation of each of the actuators 128, 130 may be controlled to actuate the joint system 62.

Although the illustrated embodiment includes two extensions 132, 134, an additional or alternative embodiment may include any suitable number of extensions, such as one extension, three extensions, or four or more extensions. A corresponding actuator may comprise and/or control each extension. As an example, additional extensions may be implemented to enable additional movement, such as in additional rotational directions, of the plates 92 relative to one another.

The control system 66 may be configured to operate the actuators 128, 130 independently of one another. That is, for example, the control system 66 may operate the first actuator 128 to retract the first extension 132 spanning from the first actuator 128 to the first mounting point 136 and, separately, operate the second actuator 130 to increase of the extended length of the second extension 134 spanning from the second actuator 130 to the second mounting point 138. In this way, the control system 66 may acutely adjust the extended lengths of the extensions 132, 134 spanning from the actuators 128, 130, respectively, to the first plate 92A to provide desirable positioning and/or movement of the plates 92 relative to one another to actuate the joint system 62.

The extensions 132, 134 may also extend through the biasing supports 96 to couple and/or connect to the first plate 92A. Thus, the biasing supports 96 may also include openings through which the extensions 132, 134 may extend, and such openings may enable relative movement between the extensions 132, 134 and the biasing supports 96. The biasing supports 96 may reduce operation of the actuators 128, 130, such as respective amounts of force and/or torque applied by the actuators 128, 130, to effectuate desirable positioning of the joint system 62. By way of example, the biasing supports 96 may apply a force that maintains the positioning of the first plate 92A relative to the second plate 92B, as well as positioning of the other plates 92 with respect to one another, without operation of the actuators 128, 130 to apply substantial forces on the mounting points 136, 138. For instance, the biasing support 96 coupled to the first plate 92A and to the second plate 92B may dampen, limit, eliminate, and/or prevent unwanted movement of the first mounting point 136 toward the second plate 92B and/or dampen, limit, eliminate, and/or prevent unwanted movement of the second mounting point 138 toward the second plate 92B while the extensions 132, 134 do not apply substantial amounts of forces onto the first plate 92A. In this manner, the relative positioning between the plates 92 may be maintained via the biasing supports 96 instead of via the extensions 132, 134 as operated by the actuators 128, 130, thereby enabling reduced operation of the actuators 128, 130.

Moreover, in an embodiment, any of the plates 92 (e.g., the first plate 92A) may be coupled and/or attached to an additional component. The additional component may include weight, an actuator, a robotic manipulator, end effector, and/or a light-emitting device (e.g., a light bulb, light emitting diode (LED)). In such an embodiment, the extensions 132, 134 may support a weight of the additional component. As such, the additional component may apply an additional force (e.g., weight of the additional component, weight of any objects picked up by the additional component) onto the extensions 132, 134. The biasing support 96 may absorb and/or distribute the additional force applied by the additional component and/or reduce the amount of force applied by additional component acting on the extensions 132, 134. In this manner, the biasing support 96 may facilitate movement of the plates 92 (e.g., to drive corresponding movement of the additional component) and/or stability of the plates 92 (e.g., to hold a position of the additional component).

A biasing support 96 may also have regions of different stiffness (e.g., stiffness constants, spring constants). Thus, different regions of the biasing support 96 may apply different magnitudes of forces onto a plate 92. As an example, a first region of the biasing support 96 adjacent to the first extension 132 may have a greater stiffness (e.g., stiffness constant, spring constant) than that at a second region of the biasing support 96 adjacent to the second extension 134. Thus, a relatively greater amount of force and resistance may be imparted on a portion of a plate 92 adjacent to the first extension 132. As a result, a greater amount of force may be applied to the first extension 132 (e.g., via the first actuator 128) to cause movement of the plate 92 than that applied to the second extension 134 (e.g., via the second actuator 130) to cause similar movement of the plate 92. The varying stiffness of the biasing support 96 may influence more desirable movement of the plate 92 via operation of the actuators 128, 130. By way of example, utilization of a biasing support 96 having a region of relatively smaller spring constant adjacent to the second extension 134 may enable operation of the first actuator 128 to cause movement of the plate 92 via the first extension 132 more easily (e.g., via a relatively lower output torque).

Figure 4:
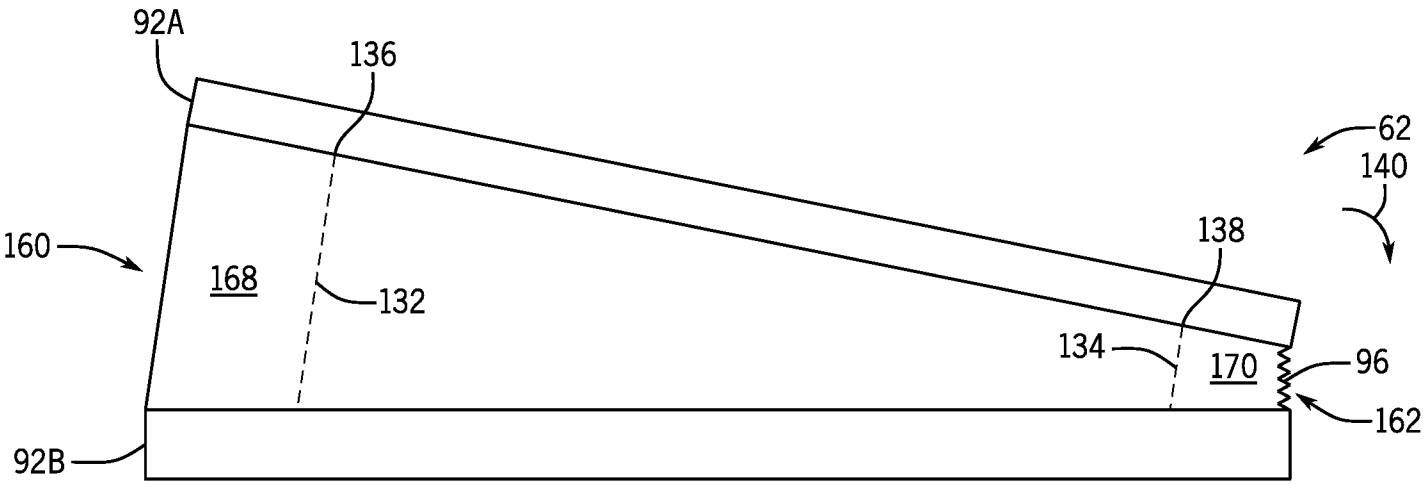
FIG. 4 is a detailed side view of an embodiment of a joint system that may be employed in a prop, in accordance with an aspect of the present disclosure.

FIG. 4 is a detailed view of an embodiment of the joint system 62. For example, the illustrated embodiment may include a motion configuration of the joint system 62, such as an operation (e.g., retraction of the second extension 134 from its corresponding actuator to the first plate 92A) to drive movement of the second mounting point 138 toward the second plate 92B to cause movement of the first plate 92A in the rotational direction 140 relative to the second plate 92B. As a result, in the illustrated motion configuration, the first mounting point 136 may correspondingly be driven away from the second plate 92B. Thus, a first end 160 of the biasing support 96 coupled to the first plate 92A (e.g., at the first mounting point 136) may be expanded, and a second end 162 of the biasing support 96 coupled to the first plate 92A (e.g., at the second mounting point 138) may be compressed.

In a further embodiment, the biasing support 96 may apply forces to the plates in opposing directions (e.g., opposing directions 166). For example, the biasing support 96 may urge movement of the first plate 92A and the second plate 92B away from one another. In this manner, the biasing support 96 may facilitate operation of the extensions 132, 134 to move the first plate 92A (e.g., the first mounting point 136, the second mounting point 138) away from the second plate 92B. Additionally or alternatively, the biasing support 96 may concurrently apply a first set of magnitude and/or direction of forces (e.g., at the compressed second end 162 in the illustrated motion configuration) and a second set of magnitude and/or direction of forces (e.g., at the expanded first end 160 in the illustrated motion configuration) to the first plate 92A and/or to the second plate 92B. The concurrent application of the first set of magnitude and/or direction of forces and the second set of magnitude and/or direction of forces may create a force equilibrium that may facilitate operation of the joint system 62 (e.g., to distribute a force that would otherwise be imparted onto the extensions 132, 134 and corresponding actuators during movement of the first plate 92A relative to the second plate 92B).

The biasing support 96 may also apply a different magnitude of forces at different regions of the biasing support 96. For example, the biasing support 96 may include a first region 168 in engagement with the first mounting point 136 and a second region 170 in engagement with the second mounting point 138. The stiffness of the first region 168 may be greater than the stiffness of the second region 170. Thus, in the illustrated motion configuration, the forces applied by the biasing support 96 to a plate 92 at the first end 160 may be greater than the forces applied by the biasing support 96 to the plate 92 at the second end 162. The different amounts of forces concurrently applied to different parts of a plate 92 may cause more desirable operation of the actuators. For instance, the increased force applied by the biasing support 96 onto the plates 92 at the first end 160 in the illustrated motion configuration may provide greater reduction of stress imparted onto the first extension 132 to maintain the structural integrity of the first extension 132 and/or enable reduced operation of the first actuator 128 (see FIG. 3), e.g., to move the plates 92.

Another biasing support 96 coupled to other plates 92 of the joint system 62 may similarly facilitate relative movement between the plates 92. That is, other biasing supports 96 may apply forces (e.g., as a result of deformation of the biasing supports 96) that urge movement between different portions of the plates 92, thereby reducing a force to be applied to cause relative movement between the plates 92. As such, the other biasing supports 96 may further reduce stress imparted onto the extensions 132, 134 and/or further reduce operation of the actuators during operation to actuate the joint system 62. Indeed, implementation of additional biasing supports 96 may also improve operation of the joint system 62.

Figure 5:
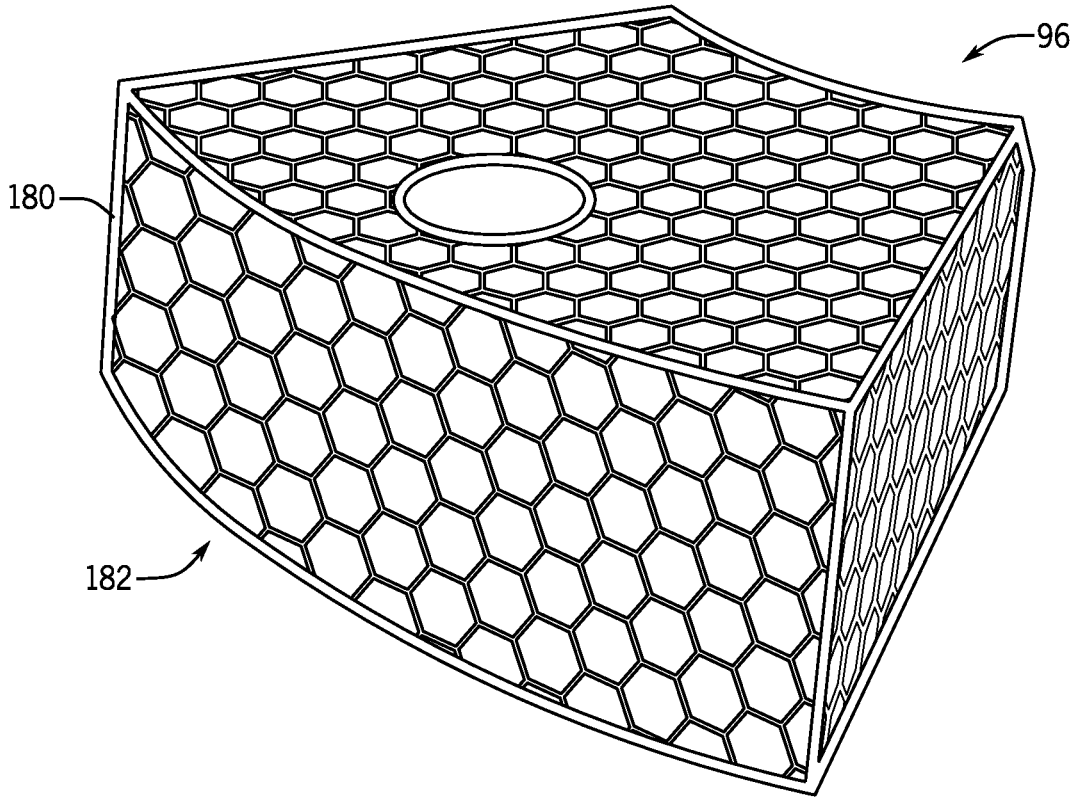
FIG. 5 is a partial perspective view of an embodiment of a biasing support that may be employed in a joint system of a prop, in accordance with an aspect of the present disclosure.

FIG. 5 is a partial perspective view of an embodiment of the biasing support 96. The illustrated biasing support 96 includes a mesh structure 180 with interconnected material, such as struts, to form spaces 182 (e.g., holes, openings, gaps) in open-celled arrangements. To facilitate deformation of the mesh structure 180 (e.g., caused by movement of the plates coupled to the biasing support 96), the mesh structure 180 may be composed of a pliable material and/or elastically deformable material, such as resin and/or polymeric (e.g., rubber, elastic). Such material may also provide sufficient structural integrity to resist wearing and/or fatigue caused by constant deformation during relative movement between the plates, thereby increasing a useful lifespan of the joint system.

Additionally, the arrangement of the mesh structure 180 may facilitate causing and/or allowing the force imparted at certain parts of the biasing support 96 to provide relative movement between the plates coupled to the biasing support 96. As an example, increasing the amount of material within a volume of the mesh structure 180 to reduce the amount of open space 182 within the volume, thereby increasing the density of the mesh structure 180 at the volume, may increase the spring constant of the biasing support 96, increase the force imparted by the biasing support 96, and/or increase resistance of deformation of the biasing support 96 at the volume. As another example, reducing the amount of material within a volume of the mesh structure 180 to increase the amount of open space 182 within the volume, thereby reducing the density of the mesh structure 180 at the volume, may reduce the spring constant of the biasing support 96, reduce the force imparted by the biasing support 96, and/or reduce resistance of deformation of the biasing support 96 at the volume. Different regions of the mesh structure 180 may have different densities and therefore different spring constants. Thus, the mesh structure 180 may be configured to apply different amounts of forces at the different regions.

For instance, different biasing supports 96 may have mesh structures 180 with different densities and/or stiffness in order to adjust and/or bias against movement of the plates caused by operation of actuators (e.g., to adjust an amount and/or directionality of movement of the plates caused by a particular amount of force or torque applied by the actuators). In an embodiment, different biasing supports 96 may be interchangeably implemented in a joint system. By way of example, in order to reduce movement of plates effectuated by operation of the actuator, a biasing support 96 having an increased density and/or stiffness may be implemented in the joint system to increase resistance of relative movement between the plates. That is, relative movement between the plates may be reduced via implementation of a new biasing support 96 while operation of the actuator (e.g., a force applied by the actuator) is maintained. Similarly, in order to increase movement of plates effectuated by operation of the actuator, a biasing support 96 having a reduced density and/or stiffness may be implemented in the joint system to reduce resistance of relative movement between the plates. In this manner, relative movement between the plates may be reduced by adjusting the biasing support 96 implemented in the joint system without having to change operation and/or implementation of the actuator and/or the control system configured to operate the actuator to facilitate adjusting operation of the joint system.

The mesh structure 180 may also be manufactured to provide other properties. As an example, the mesh structure 180 may be manufactured to control a manner in which the mesh structure 180 deforms, such as to reduce an amount of outward expansion of the mesh structure 180 (e.g., away from joints where plates are coupled) during compression. As another example, the mesh structure 180 may be manufactured to have particularly sized spaces 182, such as spaces 182 having reduced individual sizes (e.g., diameters) to limit, eliminate, and/or prevent insertion and/or entrapment of unwanted particles (e.g., debris, dirt, other joint system components) within the mesh structure 180. Indeed, the mesh structure 180 may have various structural properties to provide desirable characteristics for implementation in the joint system.

Additionally, the mesh structure 180 may be manufactured to enable securement of the mesh structure 180 to plates. As an example, the mesh structure 180 may form spaces 182 that enable insertion of a separate component, such as a ziptie, a magnet, an adhesive (e.g., resin curing, glue), a snap, a button, and/or a hook, through one of the spaces 182 to couple and/or attach the mesh structure 180 to one of the plates. For instance, the component may compress the mesh structure 180 against the plate to secure the mesh structure 180 to the plate. The mesh structure 180 may additionally, or alternatively, form a feature, such as a punch, an insert, and/or a key, that may engage with the plate to secure the mesh structure 180 to the plate. The mesh structure 180 and the plate may also be easily decoupled or disengaged from one another (e.g., by a user without additional tooling) to enable the biasing support 96 to be more easily removed from a joint system, such as for maintenance, replacement, inspection, and so forth.

The spaces 182 defined by the mesh structure 180 may also be sized to enable insertion of the extensions through the mesh structure 180 (e.g., to enable the extensions to extend toward a plate). In one embodiment, the biasing support 96 may include a sleeve, a sheath, an enclosure, a wall, a partition, and so forth, which may be defined by the mesh structure 180, to shield the extensions from the mesh structure 180. Thus, contact between the extensions and the mesh structure 180 may be limited, eliminated, and/or prevent to maintain structural integrity of the extensions and/or of the mesh structure 180. For example, limiting, eliminating, and/or preventing contact between the extensions and the mesh structure 180 may dampen, limit, eliminate, and/or prevent an unwanted force from being exerted by the extension onto the mesh structure 180 and/or dampen, limit, eliminate, and/or prevent an unwanted force from being exerted by the mesh structure 180 onto the extension, such as during deformation of the biasing support 96. There may be sufficient clearance provided by the mesh structure 180 to avoid restriction of movement of the extension through the spaces 182 and to facilitate relative movement between the extensions and the mesh structure 180, thereby facilitating movement of the plates and actuation of the joint system. If the clearance is sufficiently narrow, pushing actuation utilizing the extensions may be facilitated. For example, a sleeve, sheath, or an enclosure may provide added external support to an extension to improve the extension's ability to apply a pushing force while maintaining structural integrity and without failing.

The mesh structure 180 may be manufactured via additive manufacturing (e.g., three-dimensional (3D) printing) in an embodiment. Such a manufacturing process may enable greater control of the arrangement of the mesh structure 180 to provide desirable operation and/or appearance of the joint system. For instance, additive manufacturing machinery may be pre-programmed or pre-set to operate and form the mesh structure 180 having a particular density value, a particular mesh strut size/geometry, a particular mesh or cell type/shape, a particular density distribution, and/or a particular density profile. However, other manufacturing techniques may be used to form the mesh structure 180 in an additional or alternative embodiment. For example, injection molding and/or subtractive manufacturing may be utilized.

In addition to or as an alternative to the mesh structure 180, the biasing support 96 may include other features that are deformable via relative movement between the plates and that apply a biasing force onto the plates. For example, the biasing support 96 may include a foam, a spring (e.g., a coil spring), and the like, and such structure may also be manufactured to impart different resistances (e.g., at different regions of the structure, via different biasing supports 96) of relative movement between the plates. Indeed, any suitable structure configured to apply a biasing force onto the plates may be utilized in the biasing support 96.

Existing joint systems may be retrofit with any of the biasing supports 96 discussed herein. For example, a particular mesh structure 180 may be manufactured for an existing joint system, such as based on desirable movement of the plates of the existing joint system, the size of the space between the plates, specification (e.g., dimensions) of the plates, and so forth. As such, the benefits provided by the biasing support 96 may be realized for any suitable joint system, including joint systems that may not previously employ a biasing support 96.

Figure 6:
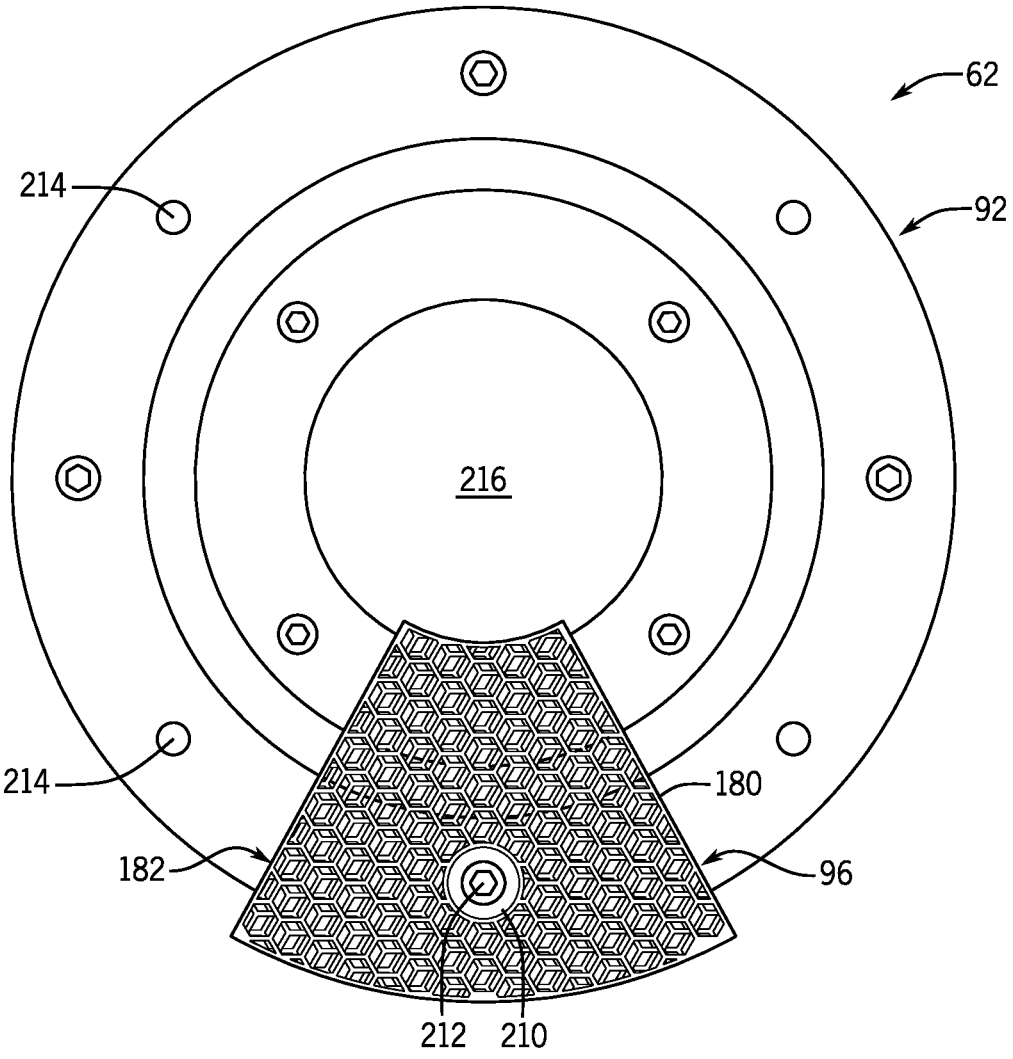
FIG. 6 is a top view of an embodiment of a joint system having a biasing support coupled to a plate, in accordance with an aspect of the present disclosure.

FIG. 6 is a top view of an embodiment of the joint system 62 illustrating coupling between a portion of a biasing support 96 and one of the plates 92. In the illustrated embodiment, the biasing support 96 includes a fastener opening 210 (e.g., one of the spaces 182 of the mesh structure 180). The fastener opening 210 may enable a fastener 212 to be inserted through the biasing support 96 and into the plate 92. For example, the fastener 212 may be utilized to couple the mesh structure 180 to the plate 92 and/or to couple the plate 92 to another component (e.g., to a base). Moreover, the plate 92 may include various extension openings 214 through which a respective extension may be inserted, such as for coupling to an end plate. In an assembled configuration of the joint system 62, each extension opening 214 may align with a corresponding space 182 of the mesh structure 180 to enable each extension to extend through the plate 92 and the mesh structure 180 via the aligned extension opening 214 and space 182.

In the assembled configuration, the biasing support 96 may surround an interior volume 216 (e.g., a chamber, an interior space) within the joint system 62. That is, the biasing support 96 may define an opening that may align with the interior volume 216. In an embodiment, a joint via which multiple plates are coupled to one another may be disposed within the interior volume 216. As such, in the assembled configuration, the biasing support 96 may enclose the joint.

Although the plate 92 and the biasing support 96 include circular or elliptical shapes in the illustrated embodiment, the plate 92 and/or the biasing support 96 may include any suitable shape in an additional or alternative embodiment. For example, the plate 92 may be triangular, rectangular, pentagonal, and so forth, and the biasing support 96 may have a shape corresponding to that of the plate 92. Manufacture of the biasing support 96 to have a shape corresponding to that of the plate 92 may increase an area of contact between the biasing support 96 and the plate 92 to facilitate securement of the biasing support 96 to the plate 92. As a result, relative movement between the plates 92 may cause more desirable deformation or adjustment of the biasing supports 96 coupled thereto.

Figure 7:
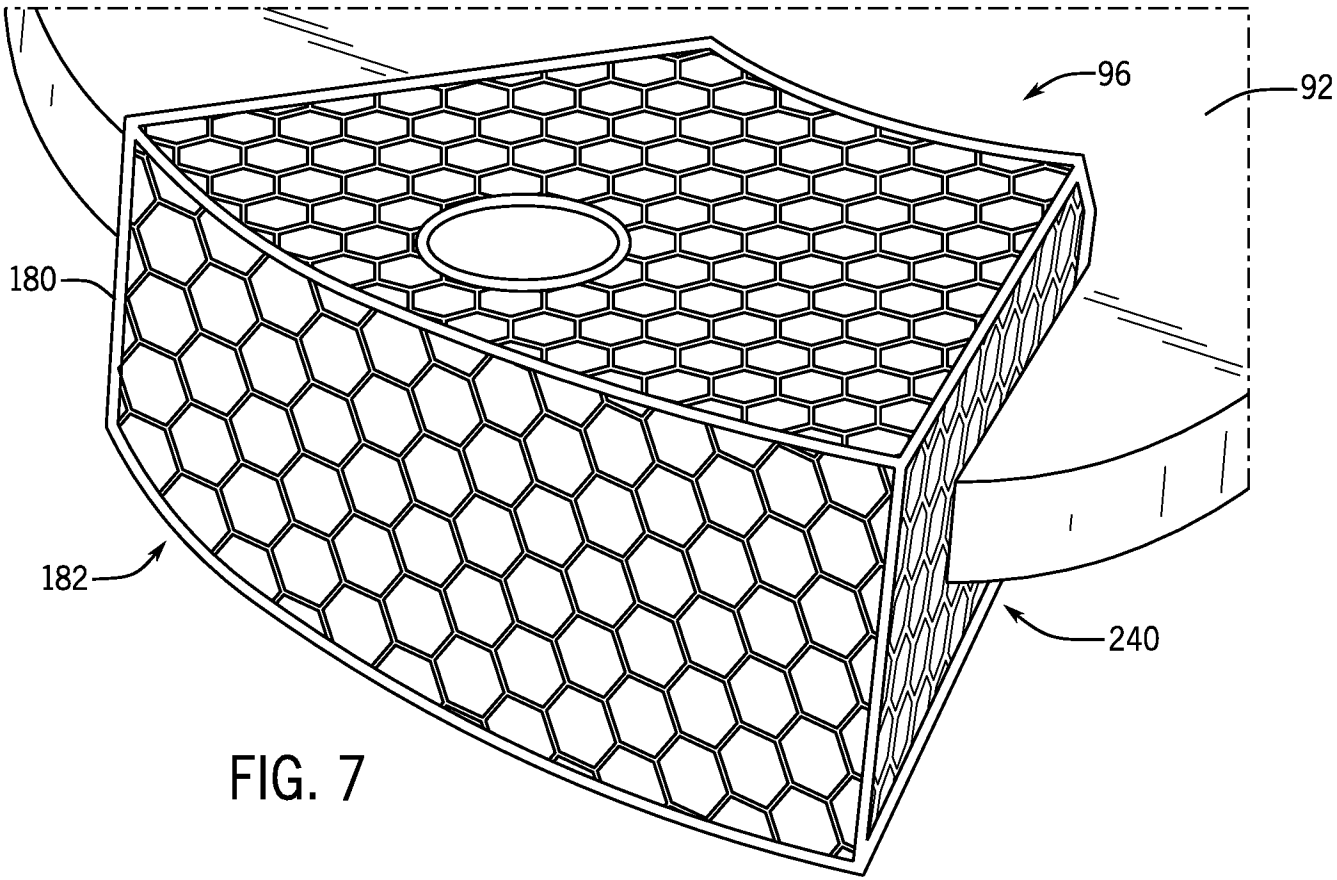
FIG. 7 is a partial perspective view of an embodiment of a biasing support coupled to a plate, in accordance with an aspect of the present disclosure.

FIG. 7 is a perspective view of an embodiment of the biasing support 96. In the illustrated embodiment, the mesh structure 180 of the biasing support 96 includes a slot 240 configured to receive the plate 92 in order to couple the biasing support 96 to the plate 92. For example, the plate 92 may be inserted within the slot 240, and the mesh structure 180 may capture the plate 92 within the slot 240, thereby dampening, limiting, eliminating, and/or preventing relative movement between the plate 92 and the biasing support 96. In one embodiment, an additional component and/or feature (e.g., a ziptie, a magnet, an adhesive, a snap, a hook, a punch, an insert, a key) may be utilized for further securement between the plate 92 and the biasing support 96. It should be noted that a biasing support 96 may define multiple slots 240 in order to couple to the biasing support 96 to multiple plates 92. As such, a single biasing support 96 may be implemented to provide desirable relative movement between more than two plates 92. For example, a joint system having three or more plates 92 may utilize a single biasing support 96 that extends between adjacent plates 92. Thus, ease of manufacture of the biasing support 96 may be improved, such as in comparison to manufacture of a separate biasing support 96 for positioning between adjacent plates 92.

Other embodiments may also be utilized in a joint system to control relative movement between the plates 92 of the joint system. By way of example, a single, integral component having the mesh structure 180 and the plate 92 may be implemented. For instance, different materials for the mesh structure 180 and for the plate 92 may be utilized to provide a joint system via a single manufacturing process (e.g., additive manufacturing). Manufacture of an integral component that includes both the biasing support 96 and the plate 92 may further improve ease of manufacture, such as in comparison to separately manufacturing the biasing support 96 and the plate 92 and coupling the separately manufacturing biasing support 96 and plate 92 to one another.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function) . . . " or "step for (perform)ing (a function) . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A prop of an attraction system, the prop comprising:

a plurality of plates comprising a first plate and a second plate coupled to the first plate, wherein the second plate is configured to move relative to the first plate; and a biasing support comprising a mesh structure coupled to and extending between the first plate and the second plate, wherein the biasing support is configured to deform during relative movement between the first plate and the second plate, and the biasing support is configured to apply a force onto the first plate, the second plate, or both upon deformation.

2. The prop of claim 1, comprising an actuator and an extension coupled to the actuator, wherein the extension extends from the actuator, through the second plate, and to the first plate, and the actuator is configured to adjust an extended length of the extension extending from the actuator to the first plate to cause the relative movement between the first plate and the second plate.

3. The prop of claim 2, wherein the mesh structure of the biasing support forms an opening, and the extension extends through the biasing support via the opening.

4. The prop of claim 2, wherein the actuator is configured to retract the extension extending from the actuator to the first plate to move the first plate toward the second plate.

5. The prop of claim 1, wherein the mesh structure of the biasing support comprises interconnected material that forms spaces in open-celled arrangements, and the mesh structure comprises varying material densities at different regions of the mesh structure.

6. The prop of claim 1, wherein the first plate and the second plate are coupled to one another at a joint, and the biasing support encloses the joint.

7. The prop of claim 1, wherein the mesh structure comprises a first region and a second region, the first region comprises a first spring constant, the second region comprises a second spring constant, and the first spring constant and the second spring constant are different from one another.

8. A joint system, comprising:

a first plate;

a second plate coupled to the first plate;

a first extension coupled to the first plate at a first mounting point;

a second extension coupled to the first plate at a second mounting point; and a biasing support coupled to the first plate and to the second plate, wherein the biasing support comprises a first region in engagement with the first mounting point and a second region in engagement with the second mounting point, the first region of the biasing support comprises a first stiffness, the second region of the biasing support comprises a second stiffness, and the first stiffness and the second stiffness are different from one another and wherein the biasing support defines a slot configured to receive the second plate, and the biasing support is configured to capture the second plate within the slot to couple to the second plate.

9. The joint system of claim 8, wherein the second plate is coupled to the first plate at a joint, the first plate is configured to move relative to the second plate about the joint to deform the biasing support, and the biasing support is configured to apply a force onto at least the first plate upon deformation via relative movement between the first plate and the second plate.

10. The joint system of claim 8, wherein the biasing support comprises a lattice structure.

11. The joint system of claim 10, wherein the lattice structure at the first region comprises a first structural material to open space ratio, the lattice structure at the second region comprises a second structural material to open space ratio, and the first structural material to open space ratio is greater than the second structural material to open space ratio such that the first spring constant is greater than the second spring constant.

12. The joint system of claim 8, wherein the biasing support defines an opening configured to receive a fastener to couple the biasing support to at least the first plate or the second plate.

13. The joint system of claim 8, wherein each of the first extension and the second extension extends through the second plate and the biasing support and to the first plate.

14. A method of actuating a prop, the method comprising:

moving, via an actuator of the prop, a first plate of the prop relative to a second plate of the prop, wherein the prop comprises a biasing support, the biasing support comprising an open-cell structure, coupled to and extending between the first plate and the second plate, and the biasing support is configured to deform during movement between the first plate and the second plate.

15. The method of claim 14, wherein the prop comprises an extension coupled to the first plate, and moving the first plate relative to the second plate comprises adjusting the extension via the actuator.

16. The method of claim 15, wherein the extension is coupled to the actuator and the first plate, and moving the first plate relative to the second plate comprises adjusting, via the actuator, an extended length of the extension extending from the actuator to the first plate.

17. The method of claim 15, wherein the extension is coupled to the first plate at a mounting point, and moving the first plate relative to the second plate via the actuator drives movement of the mounting point toward the second plate, thereby compressing the biasing support at the mounting point.

18. The method of claim 17, wherein the prop comprises an additional extension coupled to the first plate at an additional mounting point, and the method comprises moving, via an additional actuator of the prop, the first plate relative to the second plate to drive movement of the additional mounting point away from the second plate, thereby expanding the biasing support at the additional mounting point.

19. The method of claim 14, wherein moving the first plate relative to the second plate comprises operating the actuator via a control system.

* * * * *